US010064481B2

(12) United States Patent
Mehlhorn et al.

(10) Patent No.: US 10,064,481 B2
(45) Date of Patent: Sep. 4, 2018

(54) CLEANING BRUSH FOR CLEANING CLOTHING IN A TEXTILE MACHINE

(71) Applicant: Maschinenfabrik Rieter AG, Winterthur (CH)

(72) Inventors: Rainer Mehlhorn, Neubulach (DE); Christian Birkhäuser, Wolfhausen (CH); Christian Sauter, Flurlingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 332 days.

(21) Appl. No.: 14/862,333

(22) Filed: Sep. 23, 2015

(65) Prior Publication Data

US 2016/0081464 A1 Mar. 24, 2016

(51) Int. Cl.
*A46B 7/10* (2006.01)
*A46B 13/00* (2006.01)
(Continued)

(52) U.S. Cl.
CPC ..... *A46B 7/10* (2013.01); *A46B 3/20* (2013.01); *A46B 13/001* (2013.01);
(Continued)

(58) Field of Classification Search
CPC .... A46B 3/00; A46B 3/02; A46B 3/04; A46B 3/06; A46B 3/16; A46B 3/18; A46B 3/20; A46B 7/10; A46B 13/001; A46B 13/003; A46B 13/005; A46B 13/006; A46B 2200/3093; D06C 11/00; D06C 23/02; D06C 2700/15; D01G 15/00; D01G 15/02; D01G 15/12; D01G 15/14; D01G 15/16; D01G 15/24; D01G 15/26; D01G 15/46;
(Continued)

(56) References Cited

U.S. PATENT DOCUMENTS 455,729 A * 7/1891 Schofield ..... D06C 11/00 15/183
992,175 A * 5/1911 Dexter ..... D06C 11/00 15/104.001
(Continued)

FOREIGN PATENT DOCUMENTS

CN 203307495 U 11/2013
DE 3603287 * 8/1987
(Continued)

OTHER PUBLICATIONS

Swiss Patent Office Search Report, dated Dec. 16, 2014.

*Primary Examiner* — Mark Spisich
(74) *Attorney, Agent, or Firm* — Dority & Manning, P.A.

(57) ABSTRACT

A cleaning element to be fastened on a cylindrical basic body has a longitudinal axis and is designed as a cylindrical hollow element and comprises a skeleton and a spiked lattice stretched on the skeleton. The skeleton is connected to the spiked lattice by means of a rubber sealing compound, and an inner surface of the cleaning element facing the longitudinal axis is formed by the skeleton or the rubber sealing compound. The skeleton is formed by support rings which are arranged at certain intervals concentric with the longitudinal axis and which are held by means of one or more webs extending in the direction of the longitudinal axis.

9 Claims, 3 Drawing Sheets

(51) Int. Cl.
*D06C 11/00* (2006.01)
*D01G 15/76* (2006.01)
*A46B 3/20* (2006.01)

(52) U.S. Cl.
CPC ..... *A46B 13/003* (2013.01); *D01G 15/76* (2013.01); *D06C 11/00* (2013.01); *A46B 2200/3093* (2013.01); *D06C 2700/15* (2013.01)

(58) Field of Classification Search
CPC ..... D01G 15/48; D01G 15/50; D01G 15/76; D01G 15/78; D01G 15/80; D01G 15/84; D01G 15/86; D01G 19/10; D01G 19/105; D01G 19/22; D01G 19/24
USPC ..... 15/141.2, 179, 181–183, 198; 19/108–111, 112, 114, 128, 218, 233, 19/262–265; 26/29 R, 31, 32, 37; 492/28, 30, 33, 36, 38–40, 49, 50
See application file for complete search history.

(56) References Cited

U.S. PATENT DOCUMENTS 1,318,778 A * 10/1919 Lindsay ..... D06C 11/00 26/31
1,524,640 A * 1/1925 Nielsen ..... A46B 13/003 15/181
1,975,567 A * 10/1934 Dossmann ..... A46B 13/001 15/179
2,172,433 A 9/1939 Churchill
2,340,069 A * 1/1944 McCarthy ..... D06C 11/00 19/114
2,739,332 A * 3/1956 Flohr ..... A46B 13/001 15/198
2,877,481 A 3/1959 Van Clief, Jr.
2,929,088 A * 3/1960 Wier, Jr. ..... B08B 1/02 15/102
3,106,737 A * 10/1963 Schofield ..... A46B 13/003 15/181
3,134,123 A * 5/1964 Nelson ..... A46B 3/14 15/182
3,167,800 A * 2/1965 Mundo ..... A46B 7/04 15/179
3,281,882 A * 11/1966 Charvat ..... B24D 13/10 15/179
3,614,801 A * 10/1971 Peabody ..... A46B 13/001 15/179
3,851,350 A 12/1974 Schofield
5,083,840 A 1/1992 Young et al.

FOREIGN PATENT DOCUMENTS

DE 4334246 A1 4/1995
DE 102009016151 A1 10/2010
EP 1763597 B1 5/2008
FR 765069 * 6/1934
GB 411946 6/1934
GB 550214 * 12/1942
GB 894323 * 4/1962
WO WO 2004/015176 A1 2/2004

* cited by examiner

CLEANING BRUSH FOR CLEANING CLOTHING IN A TEXTILE MACHINE

FIELD OF THE INVENTION

The present application relates to a cleaning brush for cleaning clothing in textile machines. Such cleaning brushes, which are also referred to as clearer rollers, are used in various fiber-processing textile machines equipped with clothing. In textile machines, clothing is used in various forms for transporting fibers or for cleaning fibers. In this connection, the clothing is usually located on rollers or so-called carding or combing elements. This clothing becomes contaminated during operation by dirt and dust which adheres to the fibers to be processed or becomes clogged by fiber residues. The clothing that is used must be cleaned in order to ensure a consistent quality of the products. This cleaning usually takes place automatically during ongoing operation.

BACKGROUND

Various embodiments of clearer rollers are known from the prior art. For example, EP 1 763 597 shows a cleaning brush comprising a basic body having cleaning bristles fastened therein. In addition, DE 43 34 246 discloses a brush for cleaning clothed rollers which has bristle strips arranged on the circumference. Clearer rollers comprising a roller body having clothing strips applied thereon in a helical manner are also known from the prior art. The clothing strips are cut out of prefabricated spiked lattices. Such spiked lattices consist of fabrics or webs having U-shaped wire hooks inserted therein. The ends of the wire hooks form the bristles and can have diverse dimensions and shapes which are tailored to the intended application.

All of the cleaning brushes or dearer rollers known from the prior art have the disadvantage that, after these have become worn, they must be completely replaced or repaired which is complex process.

SUMMARY OF THE INVENTION

An object of the invention is creating a cleaning brush which is characterized by a simple design and which permits easy replacement of the cleaning elements. Additional objects and advantages of the invention will be set forth in part in the following description, or may be obvious from the description, or may be learned through practice of the invention.

The objects are achieved by the features described herein.

A cleaning brush having a shaft and cleaning elements slid onto the shaft is proposed. The cleaning elements are intended to be fastened on a cylindrical basic body, e.g., a shaft. The cleaning elements are designed as cylindrical hollow elements having a longitudinal axis and comprise a skeleton and a spiked lattice applied on the skeleton. The skeleton is connected to the spiked lattice by means of a rubber sealing compound, and an inner surface of the cleaning element facing the longitudinal axis is formed by the skeleton or the rubber sealing compound.

Advantageously, the skeleton is formed by support rings which are arranged at certain intervals concentric with the longitudinal axis and which are held by means of one or more webs extending in the direction of the longitudinal axis. A spiked lattice is applied onto the support rings. Next, the inner space of the cylinder formed by the spiked lattice is filled with a rubber sealing compound, e.g., synthetic rubber. Rubber sealing compound is removed in order to form an inner space and a cylindrical hollow element is formed in order to obtain a desired shape. The spiked lattice is connected to the skeleton via the rubber sealing compound in this manner, wherein the regions of the spiked lattice between the annular supports of the skeleton are also supported via the rubber sealing compound.

In another embodiment, the skeleton is formed by a tube arranged concentric with the longitudinal axis. The spiked lattice is brought into a cylindrical shape and is placed into a device which supports the spiked lattice from the outside. The skeleton in the form of a tube is arranged within the cylindrical spiked lattice. Next, the space between the skeleton or the tube and the spiked lattice is filled with a rubber sealing compound. The spiked lattice is connected to the tube via the rubber sealing compound. Such embodiments are suitable, in particular, only when the load on the cleaning elements during operation is low, due to the properties of the rubber compound connecting the tube to the spiked lattice.

The skeleton can be made from metal or plastic. Advantageously, the skeleton or at least one skeleton element is made from polyamide as an injection-molded part.

In a first embodiment, the skeleton is designed, at the ends thereof, such that the ends of the skeletons of two adjacent cleaning elements engage into one another such that these are held against one another in a rotationally locked manner. This can be achieved, e.g., by forming mutually engaging teeth or by means of a corresponding design of the webs.

In a second embodiment, a coupling piece is provided. The skeleton of two adjacent cleaning elements is designed on the ends thereof such that the ends of two adjacent cleaning elements engage into the coupling piece located therebetween such that the cleaning elements are held against one another in a rotationally locked manner, wherein the coupling piece is accommodated in the cleaning elements. The coupling piece is slid onto the basic body between two cleaning elements. The ends of the cleaning elements are designed such that the coupling piece engages into the skeleton of the cleaning element, e.g., via a tooth system or pins, and so, after two adjacent cleaning elements have been slid together, there is no gap between the cleaning elements. The coupling piece engages into the skeletons of two adjacent cleaning elements with an exact fit and the rotationally locked hold is achieved within the cleaning elements. This results in the advantage that the skeleton of the cleaning element does not have any elements that extend beyond the length of the applied spiked lattice.

In this manner, the cleaning elements are held on the cylindrical basic body in a rotationally locked manner. To this end, the cylindrical basic body comprises, at least on one of its ends, a counterpiece corresponding to the design of the end of the cleaning element or the coupling piece. It is thereby possible to hold a plurality of cleaning elements on a single basic body in a rotationally locked manner, design the basic body as an elongated shaft, and produce the cleaning elements themselves as standardized, easily manufactured, short hollow bodies. The cleaning elements and, depending on the embodiment, the associated coupling pieces, are slid onto the shaft, and all of these are loaded in the direction of the longitudinal axis in a manner known per se, e.g., by means of screws, nuts, clamping rings, or the like.

In another embodiment, the rotationally locked hold on the basic body is ensured in that the inner surface of the cleaning elements has recesses or raised areas which extend in the direction of the longitudinal axis. The basic body has the corresponding mirror image of the raised areas or recesses of the cleaning elements, whereby a positive-fitting and, therefore, rotationally locked connection between the cleaning elements and the basis body is given. Given that the recesses or raised areas extend in the direction of the longitudinal axis, the cleaning elements can be displaced on the basis body. A plurality of cleaning elements can be slid, one behind the other, onto the same basic body.

In a preferred embodiment, the skeleton is provided with an inner sleeve on which the webs are arranged, wherein the webs, in turn, hold the outer support rings. The inner surface of the cleaning element facing the basic body is formed by the inner surface of the skeleton or the inner surface of the tube assigned to the skeleton. The shape of the tube is designed such that a positive-fitting connection to the basic body can be produced. In this case, an at least partially uniform cylindrical shape of the inner dimensions of the tube is also considered to be a positive-locking fit with a smooth shaft. A positive-locking connection is also understood to be a design in which ribs, which are spaced apart from one another, are provided in the tube and come to rest against the basic body. In this embodiment, the intermediate space bounded by the spiked lattice and the tube is filled with a rubber sealing compound.

The skeleton of a cleaning element can be composed of a plurality of components, wherein the components have plug-in connections to one another. This makes it possible to produce skeleton elements having uniform dimensions. These skeleton elements are then combined, directly or with the aid of intermediate elements, to form a skeleton of the cleaning element having the required length. An intermediate element is understood to be a component which is characterized in that the intermediate element is used only to connect two skeleton elements to form a skeleton of a cleaning element. Unlike a skeleton or skeleton element, however, the intermediate element itself does not have a web or a support ring. By selecting intermediate elements having different lengths, skeletons for producing cleaning elements having any length can be provided by joining individual skeleton elements having differently dimensioned intermediate elements.

The spiked lattice is designed as a usual web or nonwoven having U-shaped wire hooks inserted therein for use in cleaning brushes. The shape of the wire hooks or the length thereof is adapted to the application and can have various designs. The wire hooks can be distributed around the circumference or along the length of the cleaning element in a uniform manner or according to a certain pattern. The so-called needle placement of the spiked lattice depends on the eventual use of the corresponding cleaning element. The spiked lattice is applied on the skeleton such that the spiked lattice is cut to the necessary size and is shaped into a cylinder. The ends of the spiked lattice, which now adjoin one another, can be connected by gluing, stitching, or welding. Next, the spiked lattice is placed over the support rings of the skeleton. The spiked lattice is then fixed on the skeleton, which can be carried out, e.g., by means of adhesives. It is also conceivable that the skeleton is placed, with the spiked lattice, into a corresponding mold which surrounds the spiked lattice and thus fixes said spiked lattice with respect to the inner skeleton.

The rubber sealing compound is then introduced into the hollow space of the skeleton, whereby the skeleton is connected to the spiked lattice and the stable cylindrical shape of the cleaning element is obtained. The use of a rubber sealing compound has the advantage that the spiked lattice is elastically supported and, therefore, a greater cleaning effect can be achieved by means of the greater freedom of movement of the wire hooks. If the rubber sealing compound were left out, however, the spiked lattice would be too resilient and inadequate pressure would be applied on an object to be cleaned.

The cleaning brush according to the invention comprises a shaft and cleaning elements according to any one of the aforementioned embodiments slid on the shaft. It is thereby possible to create cleaning brushes depending on the need by varying the cleaning elements to be used in terms of their length, number, dimension, and applied spiked lattices. The rotationally locked connection of the cleaning elements to one another and to the shaft is achieved by means of a corresponding design of the cleaning elements and the shaft or by the use of corresponding coupling pieces.

BRIEF DESCRIPTION OF THE DRAWINGS

The invention shall be described in greater detail in the following by means of an exemplary embodiment and by reference to drawings.

DETAILED DESCRIPTION

Figure 1:
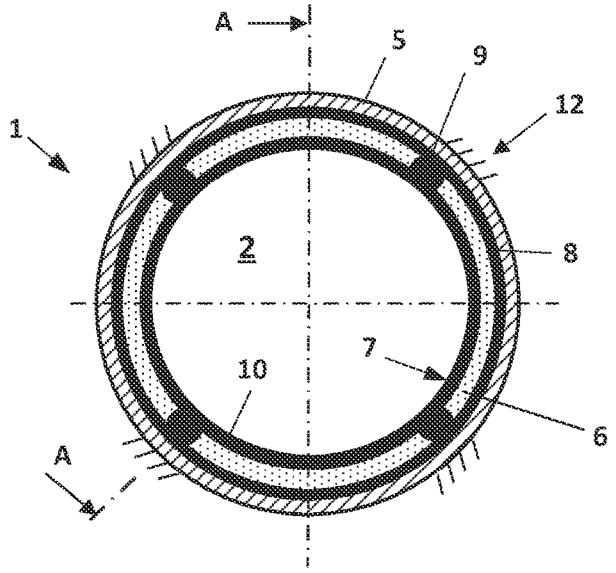
FIG. 1 shows a schematic illustration of a cross-section of a first embodiment of a cleaning element.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
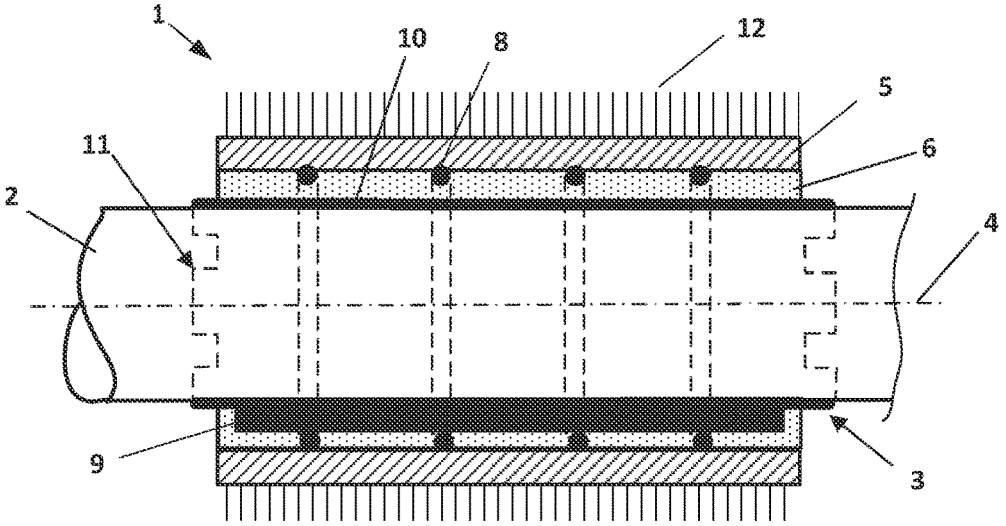
FIG. 2 shows a schematic illustration of a longitudinal section at the point A-A of the cleaning element according to FIG. 1.

FIG. 1 and FIG. 2 show a schematic illustration of a first embodiment of a cleaning element 1, wherein FIG. 1 shows the cross-section and FIG. 2 shows the longitudinal section at the point A-A according to FIG. 1. The two figures are considered together in the following. The cleaning element 1, with its longitudinal axis 4, is held on a cylindrical basic body 2 and comprises a skeleton 3 having a spiked lattice 5 on the outside. The skeleton 3 is composed of support rings 8 which are arranged concentric with the longitudinal axis 4 and are held on webs 9 extending in the direction of the longitudinal axis 4. The webs 9, in turn, are mounted on a tube 10. The tube 10 is cylindrical and has a surface 7 facing the basic body 2. The cleaning element 1 is supported on the basic body 2 via this surface 7. The condition of the surface 7 can be designed to be smooth or structured. A spiked lattice 5 is applied over the concentrically positioned support rings 8. The spiked lattice 5 has wire hooks 12 which are inserted therein and are distributed over the surface. The wire hooks 12 are schematically illustrated in the figures and can have various sizes, shapes, and lengths.

The space between the spiked lattice 5 and the tube 10 of the skeleton 3 is filled with a rubber sealing compound 6. This produces a connection between the skeleton 3 and the spiked lattice 5. The spiked lattice 5 is thereby given a stable cylindrical shape and can be slid over the skeleton 3 on the basic body 2.

The extension of the cleaning element 1 in the direction of the longitudinal axis 4 does not correspond, in every case, to the length of the basic body 2 to be provided with the cleaning elements 1. The skeleton 3, i.e., the tube 10 of the skeleton 3 in the embodiment shown, is formed so as to have teeth 11 at the ends thereof. If two cleaning elements 1 are then slid onto the basic body 2, the teeth 11 engage into one another and the two cleaning elements 1 are coupled to one another in a rotationally locked manner. The same tooth system 11 can be used on at least one end of the basic body 2 in order to hold the cleaning elements 1 on the basic body 2 in a rotationally locked manner (not illustrated).

Figure 3:
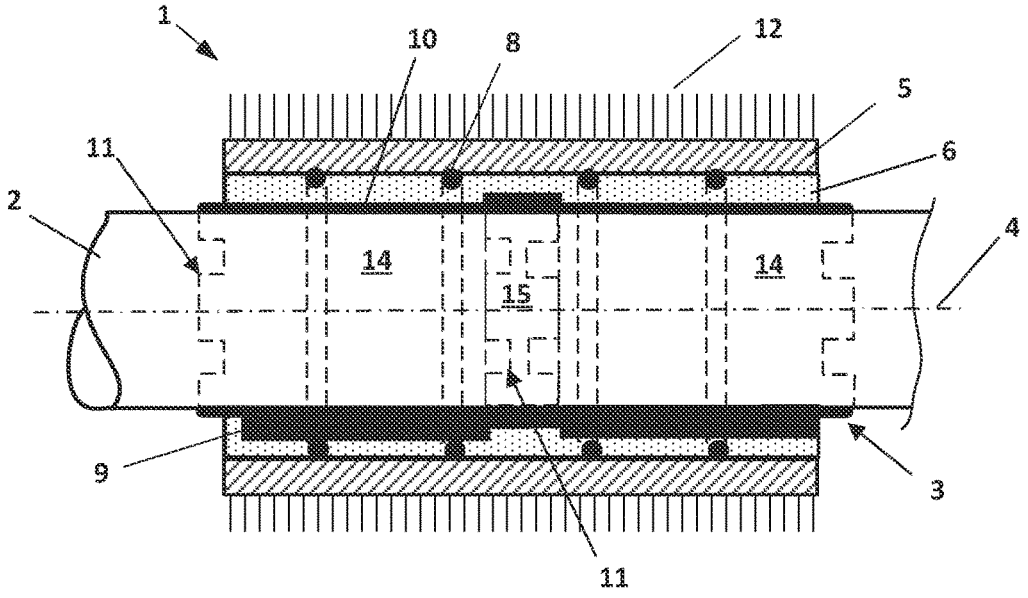
FIG. 3 shows a schematic illustration of a longitudinal section of another embodiment of a cleaning element.

FIG. 3 shows a schematic illustration of a longitudinal section of another embodiment of a cleaning element 1. The cleaning element 1 has been slid onto a basic body 2. In the embodiment shown, the cleaning element 1 comprises a skeleton 3 which is composed of a plurality of components 14, 15. Two identical skeleton elements 14, which are connected by means of an intermediate element 15, are illustrated. Each of the skeleton elements 14 has a tube 10 and support rings 8 arranged concentric with the longitudinal axis 4, each of which said support rings is held by a web 9. The intermediate element 15 is used only to couple the skeleton elements 14 and does not have support rings 8 or webs 9. The intermediate element 15 creates a rotationally locked coupling of the skeleton elements 14 by means of a tooth system 11 provided at the ends of the skeleton elements 14. By using various lengths of the intermediate element 15, it is possible to provide the cleaning elements in any length while using standardized skeleton elements 14. A spiked lattice 5 having wire hooks 12 inserted therein is applied over the entire skeleton 3 or the support rings 8 thereof. The space between the tube 10 and the spiked lattice 5 is filled with a rubber sealing compound 6.

Figure 4:
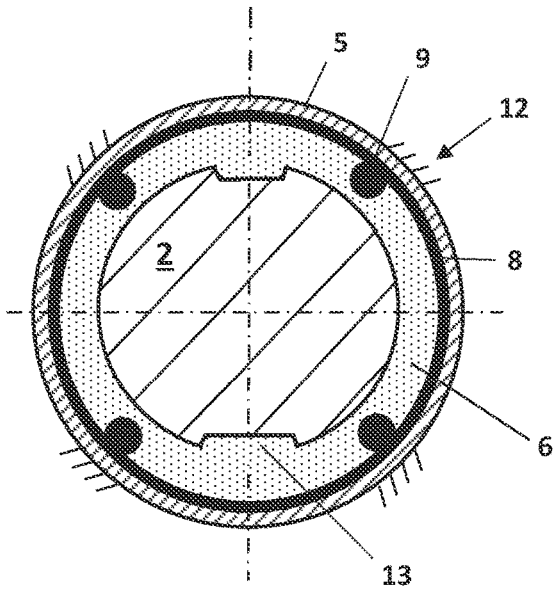
FIG. 4 shows a schematic illustration of a cross-section of another embodiment of a cleaning element.

FIG. 4 shows a schematic illustration of a cross-section of another embodiment of a cleaning element 1. The cleaning element 1 comprises a skeleton and a spiked lattice 5, which has wire hooks 12 inserted therein, applied over the skeleton. The skeleton is composed of concentrically arranged support rings 8 which are held by webs 9. The rubber sealing compound 6 connecting the skeleton and the spiked lattice 5 is introduced such that, in turn, a hollow element results, which has an inner surface having a structure or shape matched to a basic body 2. The embodiment of two raised areas 13 in the cleaning element 1 is shown in FIG. 4 as an example. In the state of use, these raised areas 13 engage into corresponding recesses of the basic body 2 and thereby result in a positive-locking and, therefore, rotationally locked connection between the cleaning element 1 and a basic body 2. The basic body 2 can be designed as a multiple-splined shaft, for example.

Figure 5:
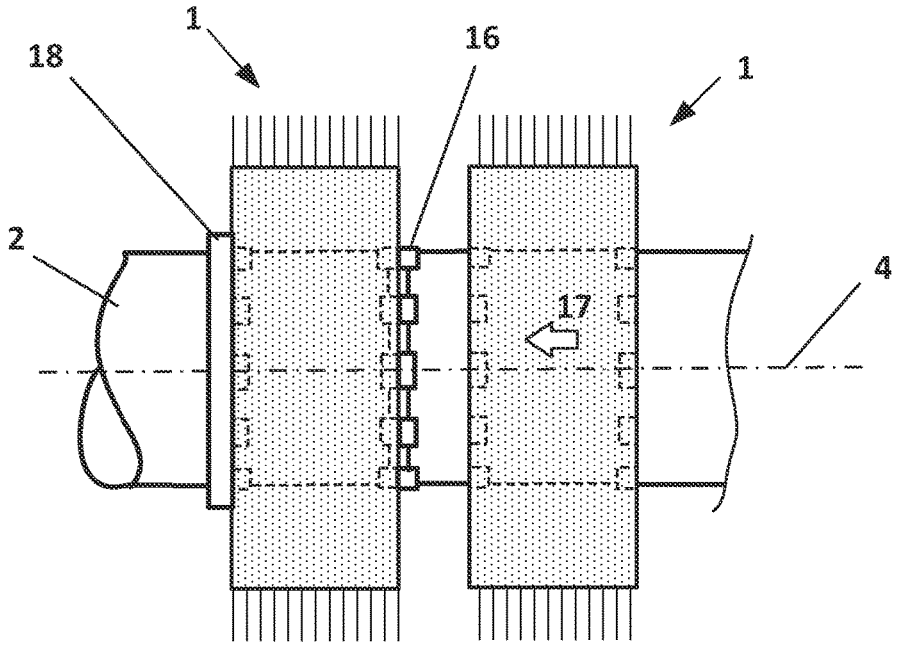
FIG. 5 shows a schematic illustration of a cleaning brush.

FIG. 5 shows a schematic illustration of the design of a cleaning brush. A plurality of cleaning elements 1 are held on a shaft 2. In this connection, a first cleaning element 1 is slid onto the shaft 2 and is held in a clamping element 18. The clamping element 18 is designed such that the cleaning element 1 is held in a rotationally locked manner. A coupling piece 16 is installed on the shaft 2 before a second cleaning element 1 is slid on. The coupling piece 16 is rotationally connected to the cleaning element 1 by means of a tooth system provided therein. Instead of a tooth system, other connections, such as pins, which result in a rotationally locked connection of the cleaning element 1 and the coupling piece 16 are also conceivable. A second cleaning element 1 is then slid onto the shaft 2 against the first cleaning element 1 in the direction of the longitudinal axis 4 and in the arrow direction 17. The second cleaning element 1 also engages into the coupling piece 16, by means of a corresponding design of the cleaning element 1. This results in a rotationally locked connection of the two cleaning elements 1 via the inserted coupling piece 16. The coupling piece 16 is completely accommodated by the two cleaning elements 1 such that, in the fully assembled state, the cleaning elements 1 rest against one another without an intermediate space therebetween.

Modifications and variations can be made to the embodiments illustrated or described herein without departing from the scope and spirit of the invention as set forth in the appended claims.

LEGEND

1 cleaning element
2 basic body
3 skeleton
4 longitudinal axis
5 spiked lattice
6 rubber sealing compound
7 inner surface of the cleaning element
8 support ring
9 web
10 tube
11 tooth
12 wire hook
13 raised area
14 skeleton element
15 intermediate element
16 coupling piece
17 direction of movement
18 clamping element

The invention claimed is:

1. A cleaning element for a textile machine, the cleaning element intended for fastening onto a cylindrical base body to form a cleaning brush for use in the textile machine, the cleaning element comprising:

a skeleton, the skeleton comprising a plurality of support rings arranged at intervals concentric with a longitudinal axis of the cleaning element, the support rings held by a plurality of webs extending longitudinally over the support rings in the direction of the longitudinal axis;

a spiked lattice applied over the skeleton;

a rubber sealing compound connecting the skeleton to the spiked lattice, the support rings disposed at least partially in the rubber sealing compound;

a cylindrical hollow element having an inner surface facing the longitudinal axis and defined by one of a tube component of the skeleton or by an inner surface of the rubber sealing compound.

2. The cleaning element according to claim 1, wherein the skeleton comprises the tube component arranged concentric with the longitudinal axis and defining the inner surface of the cylindrical hollow element facing the longitudinal axis.

3. The cleaning element according to claim 1, wherein the skeleton has opposite ends with an interlocking profile such that ends of two adjacent cleaning elements are engageable with one another in a rotationally locked manner.

4. The cleaning element according to claim 1, further comprising a coupling piece insertable between ends of two adjacent cleaning elements such that the cleaning elements are held against one another in a rotationally locked manner by the coupling piece.

5. The cleaning element according to claim 1, wherein the inner surface of the cylindrical hollow element comprises recesses or raised areas that extend in the direction of the longitudinal axis.

6. The cleaning element according to claim 1, wherein the skeleton is defined by a plurality of skeleton components arranged end to end with plug-in connections between the adjacent ends.

7. The cleaning element according to claim 1, wherein the skeleton is an injection-molded part made from polyamide.

8. The cleaning element according to claim 1, wherein the spiked lattice comprises a fabric or web having U-shaped wire hooks inserted therein.

9. A cleaning brush for use in a textile machine, comprising:

a shaft; and a cleaning element according to claim 1 slid onto the shaft.

* * * * *